US006497363B1

(12) United States Patent
Kelrich

(10) Patent No.: US 6,497,363 B1
(45) Date of Patent: Dec. 24, 2002

(54) ELECTRICAL CONNECTOR WITH IDENTIFICATION CHIP

(75) Inventor: David Kelrich, Ramat Hasharon (IL)

(73) Assignee: Del-Pak Systems (1983) Ltd., Bnei Brak (IL)

( * ) Notice: Subject to any disclaimer, the term of this patent is extended or adjusted under 35 U.S.C. 154(b) by 0 days.

(21) Appl. No.: 09/600,428

(22) PCT Filed: Jan. 15, 1999

(86) PCT No.: PCT/IL99/00027

§ 371 (c)(1),
(2), (4) Date: Sep. 21, 2000

(87) PCT Pub. No.: WO99/36887

PCT Pub. Date: Jul. 22, 1999

(30) Foreign Application Priority Data

Jan. 15, 1998 (IL) ..... 122948

(51) Int. Cl.[7] ..... G06B 15/02

(52) U.S. Cl. ..... 235/384; 235/441; 235/444; 235/453

(58) Field of Search ..... 235/384, 441, 235/444, 453

(56) References Cited

U.S. PATENT DOCUMENTS

| | | | | | |
|---|---|---|---|---|---|
| 4,345,146 | A | * | 8/1982 | Story et al. | 235/381 |
| 4,469,149 | A | * | 9/1984 | Walkey et al. | 141/346 |
| 5,347,113 | A | | 9/1994 | Reddersen et al. | |
| 5,378,882 | A | | 1/1995 | Gong et al. | |
| 5,605,182 | A | | 2/1997 | Oberrecht et al. | |
| 5,635,917 | A | | 6/1997 | Todman | |
| 5,664,229 | A | | 9/1997 | Bhargava et al. | |
| 5,675,139 | A | * | 10/1997 | Fama | 235/472 |
| 5,720,327 | A | * | 2/1998 | Foster, Jr. | 123/198 DC |
| 5,853,606 | A | * | 12/1998 | Boskovic | 249/103 |
| 5,857,501 | A | | 1/1999 | Kelerich et al. | |
| 5,923,572 | A | * | 7/1999 | Pollock | 141/94 |

FOREIGN PATENT DOCUMENTS

| | | |
|---|---|---|
| DE | 3929387 C | 5/1991 |
| DE | 19545830 | 6/1997 |
| DE | 19720747 A | 11/1997 |
| IL | 107784 | 11/1993 |
| WO | WO93/19993 | 10/1993 |
| WO | WO94/16592 | 9/1994 |
| WO | WO96/10132 | 4/1996 |

* cited by examiner

*Primary Examiner*—Karl D. Frech
*Assistant Examiner*—Seung Ho Lee
(74) *Attorney, Agent, or Firm*—Burns, Doane, Swecker & Mathis, L.L.P.

(57) ABSTRACT

A vehicle refueling system including a controller disposed in a vehicle, a fuel nozzle communicator arranged adjacent a fuel intake conduit, connected to the controller and communicating information from the vehicle to refueling systems outside thereof and a securely attached vehicle identifier assembly including a vehicle identification chip disposed in an identification portion, an output portion defining a connector coupled to the controller and a neck separating the identification portion and the connector, the vehicle identification chip including a data store containing identification data, the data store being connected to a data output in the output portion-via connectors passing through the neck, the neck securely fitting into the vehicle's chassis, the neck having a breaking strain lower than that of the remainder of the system, whereby an attempt to remove the vehicle identification chip from the vehicle by removal of the output portion, causes breakage of the vehicle identifier assembly at the neck.

5 Claims, 4 Drawing Sheets

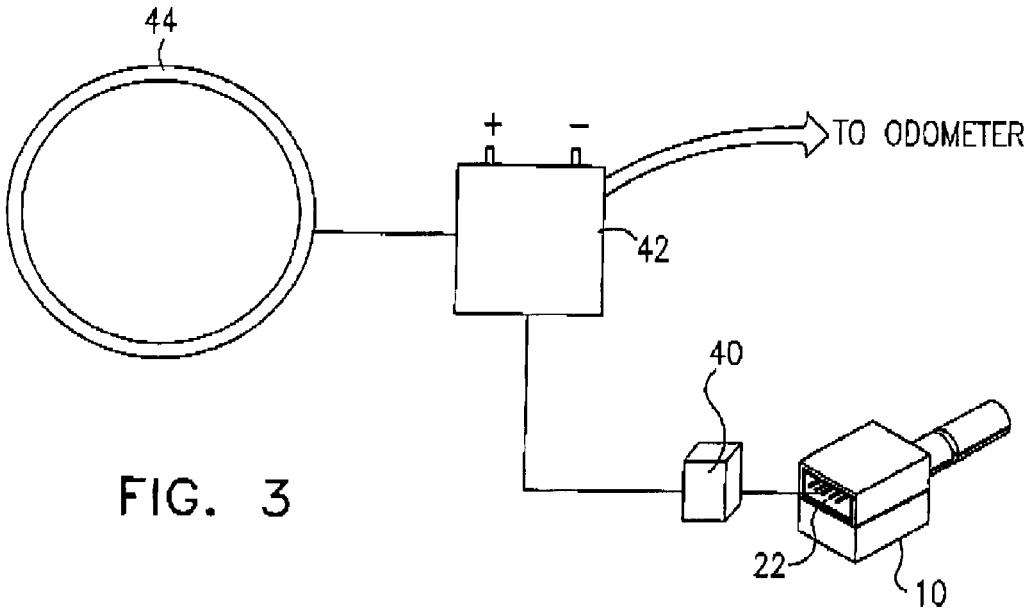
FIG. 3
FIG. 4A
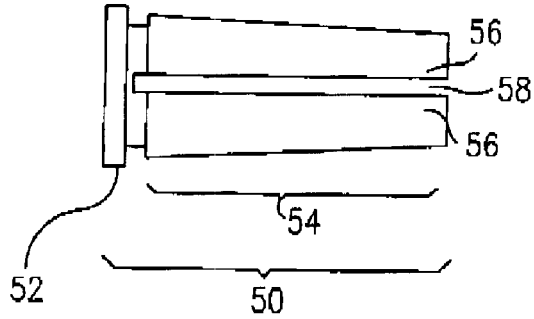
FIG. 4B
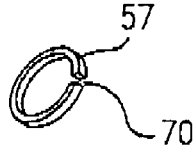

ELECTRICAL CONNECTOR WITH IDENTIFICATION CHIP

FIELD OF THE INVENTION

The present invention relates to electronic identification systems and more particularly but not exclusively to electronic identification systems for use with vehicle refueling systems.

BACKGROUND OF THE INVENTION

Vehicle refueling systems, in which a vehicle is provided with a way of identifying itself to a fuel provider, are known from Israel Patent Application Nos. 111,802 and 107,784, both of which are hereby incorporated by reference. These applications deal in essence with a system in which an inductive ring is placed around the upper end of the fuel intake pipe of a vehicle. The ring is connected up to a source of identification information regarding the vehicle, owner, charge account number, type of fuel required and the like. The information is transmitted via the inductive coil to a receiver, which may conveniently be placed on the refueling pipe, and thus relayed to the fuel provider. Such systems are popular with organizations that run large fleets of vehicles and they allow vehicle refueling to be carried out without fuss and charged to a central account and for data concerning refueling operations to be collected.

A difficulty with the prior art as represented by the two patent applications listed, is that if the source of identification information can be removed from the vehicle and taken to another vehicle then the owner of the second vehicle may be able to obtain fuel at someone else's expense. A previously proposed solution to this problem has been to connect up the system to the vehicle main computer but this introduces the problem of having to reprogram the main computer whenever any changes are made. Furthermore the main computer may itself be stolen.

It should furthermore be borne in mind that the problem is not so serious when the identification source is merely stolen. The lack of the source will become apparent at the latest the next time an attempt is made to refuel the car, and at that point the account can be canceled. What is more serious is if an attempt is made to remove the source, clone it and then replace it. In this case it is not possible to determine that anything is wrong until a statement of account is received. Even at this point such an occurrence may go unnoticed if the vehicle is part of a large fleet or it is a vehicle that is generally heavily used. Even if the problem is spotted It is not certain that compromise of the identification source will be blamed for the occurrence. The driver may initially be blamed for making unauthorized use of the vehicle.

As the identification source is most likely located within the recesses of the vehicle there is no advantage to using a standard tamper evident seal around the chip. The standard tamper evident seal requires visual inspection to determine whether tampering has taken place, and such a product would require regular visual checks inside the fuel intake, which would be unpopular with users.

SUMMARY OF THE INVENTION

According to the present invention there is provided an identification device comprising an identification portion, an output portion and a neck separating said identification portion and said connection portion. The identification portion comprises a data store containing identification data. The data store is connected to a data output in said output portion via connectors passing through the neck, and the neck is adapted to be fitted into the structure of an item to be identified, such as a vehicle. The neck has a breaking strain which is lower than that of the remainder of the device so that if an attempt is made to extract the device from the structure then the neck will break. The output of the device may be arranged to output data to a fueling device. The neck has a breaking strain which may be equal to or less than one fifth of that of the remainder of the device, and in a particularly preferred embodiment may be equal to or less than one tenth of the strain.

A preferred embodiment of the device may be inserted into the structure of the vehicle by means of the following steps, a) inserting a sleeve into a hole in said structure, said sleeve having a cylindrical outer wall with a first diameter and an entrance portion having a second diameter which is smaller than said first diameter, b) inserting a resilient collar into said neck of said device, said collar defining a diameter larger than said second diameter, and c) inserting said stem of said device, with said collar, through said entrance portion of said sleeve.

BRIEF DESCRIPTION OF THE DRAWINGS

For a better understanding of the invention and to show how the same may be carried into effect, reference will now be made, purely by way of example, to the accompanying drawings in which, FIG. 3 shows how the device of FIG. 1 may be connected to a vehicle refueling identification system, FIG. 4A shows a sleeve for use with the device of FIG. 1.

FIG. 4B shows a collar for use with the device of FIG. 1,

DESCRIPTION OF THE PREFERRED EMBODIMENTS

Figure 1:
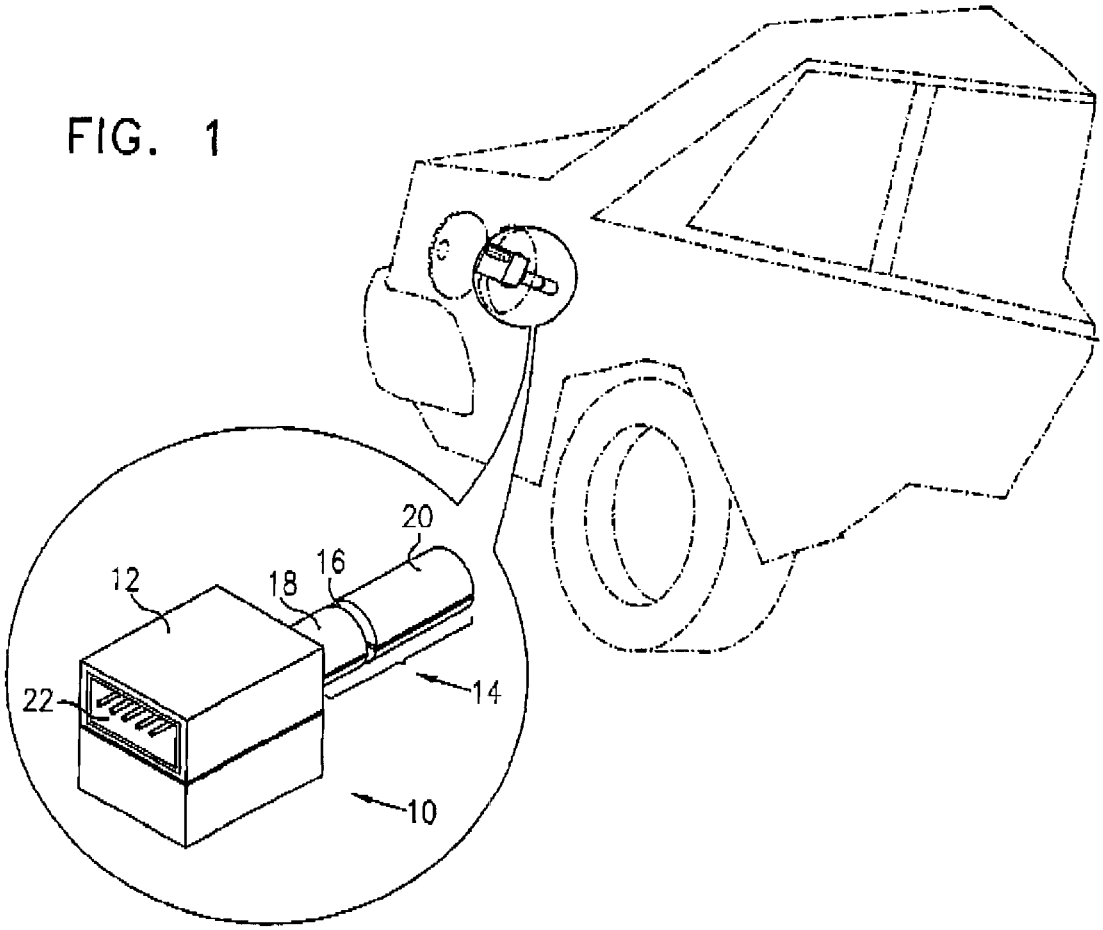
FIG. 1 shows a device according to the invention.
Figure 2:
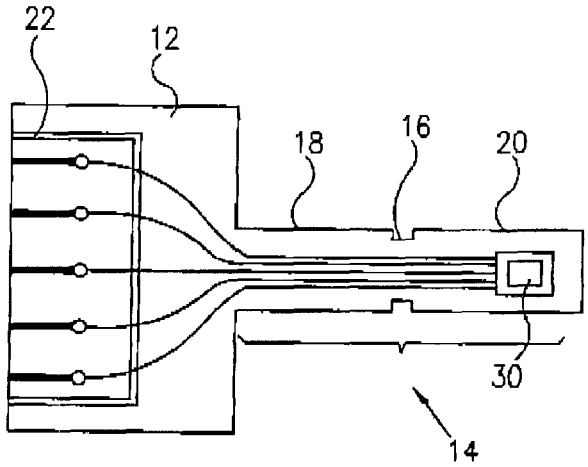
FIG. 2 shows a longitudinal cross-section of the device of FIG. 1.

FIG. 1 shows a device 10 containing an identification chip for a refueling system. The device 10 comprises a body 12 and a stem 14. The stem is divided by a neck 16 into a first portion 18 adjacent the body 12 and a second portion 20 away from the body 12. The identification chip 30 itself is embedded in the second portion 20, as shown in FIG. 2 which is a longitudinal cross-section of the device shown in FIG. 1. The fueling system is connected to the device via a socket 22 in the body 12 of the device. As shown in FIG 2 therefore, connections 32 run from the chip 30 to the socket 22, via the neck 16.

In use the device 10 is connected as shown in FIG. 3. A plug connector 40 is inserted into the socket 12 and is in turn connected to a controller 42. The controller 42 is connected to the fuel ring 44 and also to the car odometer. A refueling nozzle is inserted into the fuel intake and identification data of the vehicle is passed from the chip 30 to the system of the fuel provider via induction loops or the like as described above so that the refueling operation can be duly logged and paid for as appropriate.

The device 10 is sealed into the structure of the vehicle, using the neck 16 as an anchor point. The device is oriented so that the second part 20 of the stem 14 is concealed within the vehicle, thus denying access to the chip. The neck 16 is designed to break at a relatively low force, for example 7 kg, whereas the rest of the device 10 will not break at any force less than 70 kg. Thus any attempt to extract the chip should render it useless because the connections through the neck are broken.

The fuel ring 44 may be powered as shown in FIG. 3 or it may receive its power inductively from the device on the refueling nozzle.

FIG. 4A shows a sleeve 50 for irreversibly inserting the chip into a small hole in the structure of the vehicle. The sleeve 50 is placed into the structure of the vehicle in such a way that the outer walls of the sleeve 50 define the outer wall of a hole in the structure. The sleeve comprises a base region 52 which is a continuous ring, and an extension region 54. The extension region 54 comprises fins 56 which are continuations of the ring parallel to the longitudinal axis, but the fins are interrupted by gaps 58 therebetween allowing the fins 56 to be forced together when the sleeve is forced into a gap having a diameter smaller than that of the sleeve. Thus the sleeve may be forced into a hole in the structure of the vehicle, the fins 56 acting as anchor points.

The base region 52 of the sleeve has a diameter which is slightly smaller than that of the extension of the sleeve so that it may serve as a catch.

FIG. 4B shows a collar 57, which is inserted into the neck 16.

The collar is a resilient ring with a gap 70 in it. The gap enables the collar to squeeze through a small gap and open at the far end.

Figure 5A:
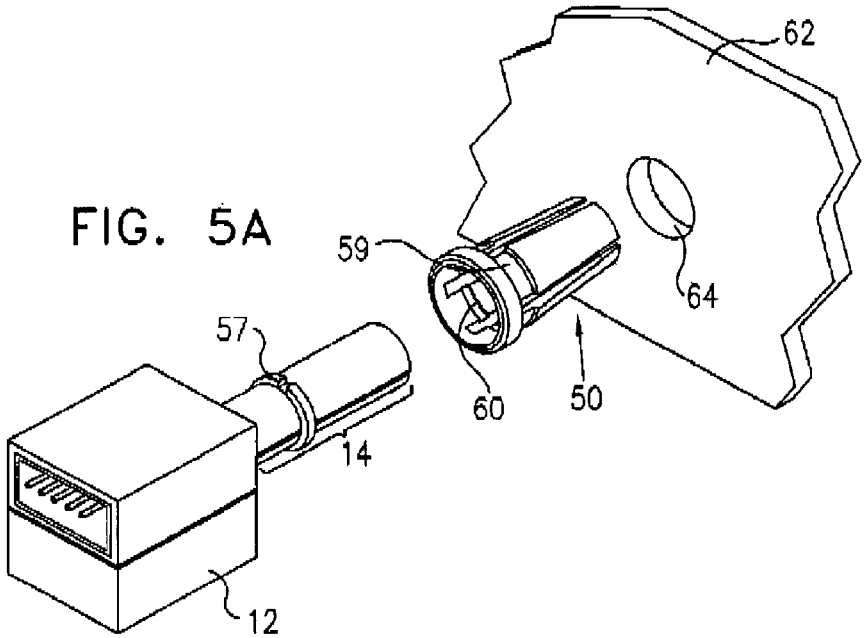
FIG. 5*a* is an exploded diagram of the device of FIG. 1 about to be inserted into the structure of a vehicle.
Figure 5B:
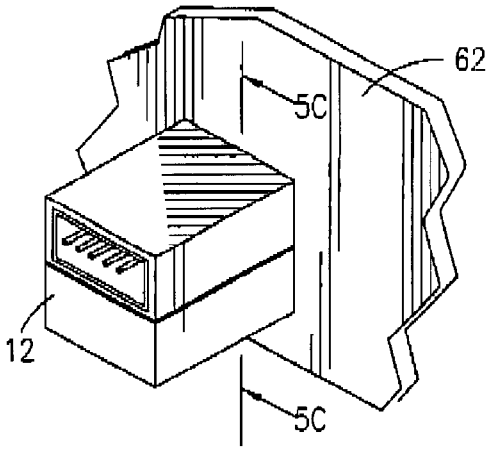
FIG. 5*b* shows the device of FIG. 1 in position in the structure of the vehicle.
Figure 5C:
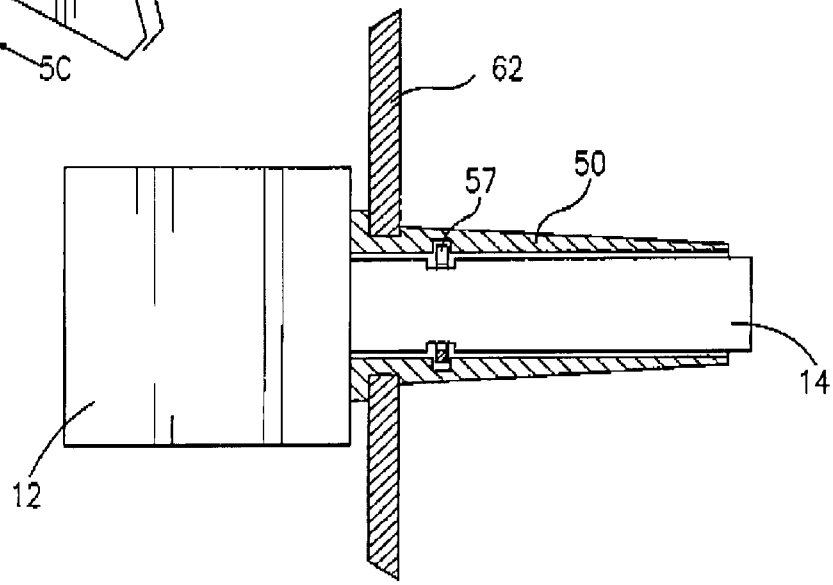
FIG. 5*c* is a cross section of the device of FIG. 5*b* taken along the axis 5*c*—5*c* thereof.
Figure 5D:
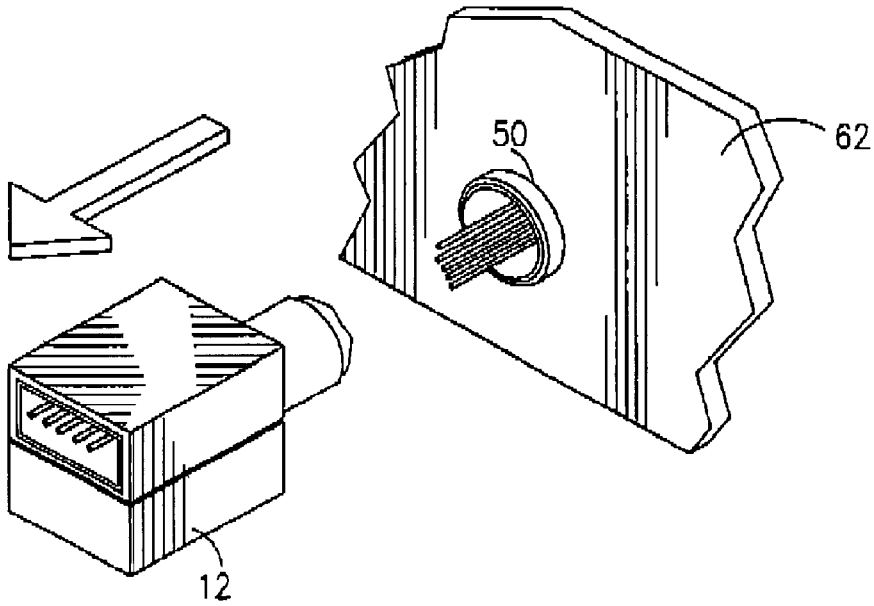
FIG. 5*d* shows the device of FIG. 1 after an attempt at tampering has been made.

As shown in FIGS. 5*a* to 5*d*, the metal collar 57 is placed within the neck 16. The diameter of the collar is slightly greater than that of the stem and also slightly greater than the inner diameter of the base region of the sleeve. FIG. 5*a* is an exploded diagram of the stem about to be added to be inserted into the structure of the vehicle. Wall 62 represents the vehicle structure and has a hole 64 for insertion of the sleeve. As shown in FIGS. 5*b* and 5*c* the sleeve is inserted into the hole 64. A hollow 59, in the wall of the sleeve between the base section 52 and the extension section 54 fits the wall surrounding hole 64. The stem, with the collar 57 inserted into the neck 16, is forced into the sleeve 50 through the base region 52. The collar is pushed inwards so that the stem slides inside the base, and then, once past the base region 52 and into the extension region 54, which is of wider diameter, the two ends of the collar 58 spring outwards so as to catch on the step 60 between the two sections. Thus the device cannot be pulled out from the sleeve 50 without placing a strain on the neck 16 and thereby breaking it.

Figure 5E:
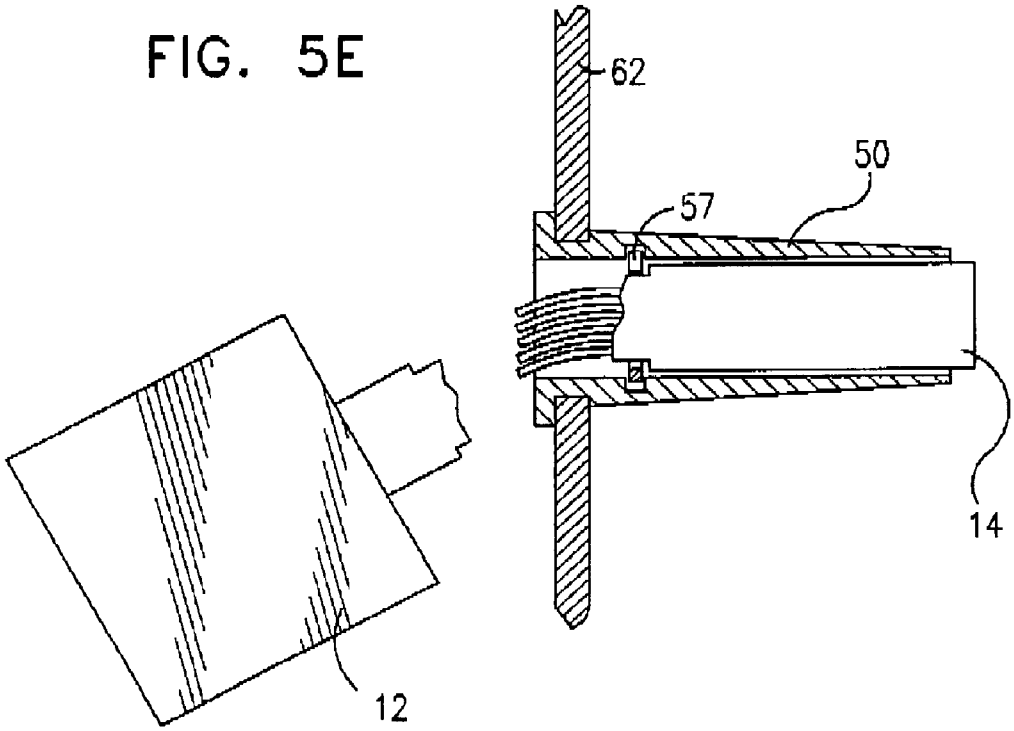
FIG. 5*e* shows the device of FIG. 5*c* after an attempt at tampering has been made.

FIG. 5*e* shows the device of FIG. 5*c* after an attempt at tampering has been made.

The sleeve and collar are one example of an irreversible fitting. Other types of irreversible fitting will be known to the skilled man and are equally applicable to the present invention.

It is appreciated that the various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

What is claimed is:

1. A vehicle refueling system comprising a controller disposed in a vehicle;

a fuel nozzle communicator arranged adjacent a fuel intake conduit of said vehicle and connected to said controller and being operative for communicating information from said vehicle to refueling systems outside of said vehicle; and a vehicle identifier assembly securely attached to said vehicle and including:

a vehicle identification chip disposed in an identification portion, an output portion defining a connector which is coupled to said controller and a neck separating said identification portion and said connector, wherein said vehicle identification chip comprises a data store containing identification data and which data store is connected to a data output in said output portion via connectors passing through said neck, wherein said neck is adapted to be securely fitted into the chassis of said vehicle and wherein said neck has a breaking strain lower than that of the remainder of said system, whereby an attempt to remove said vehicle identification chip from said vehicle by removal of said output portion, causes breakage of said vehicle identifier assembly at said neck.

2. A system according to claim 1 wherein said output is arranged to output data to a fueling device.

3. A system according to claim 1 wherein said neck has a breaking strain which is less than one fifth of that of said remainder of said system.

4. A system according to claim 1 wherein said neck has a breaking strain which is one tenth or less of that of said remainder of said system.

5. A vehicle refueling method comprising arranging a fuel nozzle communicator adjacent a fuel intake conduit of a vehicle and connected to a controller disposed in the vehicle and being operative for communicating information from said vehicle to refueling systems outside of said vehicle; and securely attaching a vehicle identifier assembly to said vehicle and including:

disposing a vehicle identification chip in an identification portion, coupling an output portion defining a connector to said controller and providing a neck separating said identification portion and said connector, wherein said vehicle identification chip comprises a data store containing identification data and which data store is connected to a data output in said output portion via connectors passing through said neck, wherein said neck is adapted to be securely fitted into the chassis of said vehicle and wherein said neck has a breaking strain lower than that of the remainder of said system, whereby an attempt to remove said vehicle identification chip from said vehicle by removal of said output portion, causes breakage of said vehicle identifier assembly at said neck.

* * * * *